US008032982B2

(12) United States Patent
Lee et al.

(10) Patent No.: US 8,032,982 B2
(45) Date of Patent: Oct. 11, 2011

(54) UPRIGHT VACUUM CLEANER HAVING SUCTION PATH SWITCHING VALVE

(75) Inventors: Byung-jo Lee, Gwangju (KR); Joung-soo Park, Jeollabuk (KR); Tae-gwang Kim, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 848 days.

(21) Appl. No.: 12/074,824

(22) Filed: Mar. 6, 2008

(65) Prior Publication Data

US 2009/0089960 A1 Apr. 9, 2009

(30) Foreign Application Priority Data

Oct. 8, 2007 (KR) ..... 10-2007-0101074

(51) Int. Cl.
*A47L 9/00* (2006.01)

(52) U.S. Cl. ..... 15/335; 15/410; 15/331; 15/334

(58) Field of Classification Search ..... 15/331, 15/334, 335, 328, 410
See application file for complete search history.

(56) References Cited

U.S. PATENT DOCUMENTS 4,377,882 A * 3/1983 Dyson ..... 15/335
4,573,236 A * 3/1986 Dyson ..... 15/333
5,477,586 A 12/1995 Jacobs et al.
7,559,112 B2 * 7/2009 Lee et al. ..... 15/331
2004/0194247 A1 * 10/2004 Macleod et al. ..... 15/335
2006/0026789 A1 * 2/2006 Fischer et al. ..... 15/334
2006/0282976 A1 * 12/2006 Richardson et al. ..... 15/335

FOREIGN PATENT DOCUMENTS

EP 1464267 10/2004

OTHER PUBLICATIONS

Search and Examination Report dated Nov. 14, 2008 corresponding to United Kingdom Patent Application No. 0813024.7.

* cited by examiner

*Primary Examiner* — Dung Van Nguyen
(74) *Attorney, Agent, or Firm* — Ohlandt, Greeley, Ruggiero & Perle, LLP

(57) ABSTRACT

An upright vacuum cleaner having a suction path switching unit is provided that includes a cleaner body having and a body frame; a suction inlet body hinged to the body frame; a hose in fluid communication with the body frame and an extension pipe; and a suction path switching unit disposed on the body frame. The suction path has an operating duct elastically arranged on a suction path to be able to slide up and down. As the extension pipe is inserted into or withdrawn from a socket disposed on the body frame, the operating duct selectively diverts the suction path to a first suction path flowing from the suction inlet body to the dust collecting unit or a second suction path flowing from the extension pipe to the dust collecting unit.

8 Claims, 4 Drawing Sheets

UPRIGHT VACUUM CLEANER HAVING SUCTION PATH SWITCHING VALVE

CROSS-REFERENCE TO RELATED APPLICATIONS

This application claims the benefit under 35 U.S.C. §119 (a) from Korean Patent Application No. 10-2007-0101074, filed on Oct. 8, 2007, in the Korean Intellectual Property Office, the disclosure of which is incorporated herein by reference in its entirety.

BACKGROUND OF THE INVENTION

1. Field of the Invention

The present disclosure relates to a vacuum cleaner, and more particularly, to an upright vacuum cleaner that is capable of selecting a suction path from a suction inlet body or from an extension pipe connected to a cleaner body to draw in dust from a cleaning surface using a suction force generated by operation of a motor in the cleaner body.

2. Description of the Related Art

In general, a vacuum cleaner is largely divided into an upright-type vacuum cleaner and a canister-type vacuum cleaner. The upright-type vacuum cleaner has a suction inlet body directly connected to a cleaner body without passing through an extra hose or an extension pipe, and can improve a cleaning efficiency using its own weight of the vacuum cleaner when cleaning a carpet.

The canister-type vacuum cleaner differs from the upright-type vacuum cleaner in that a suction inlet body fluidly communicates with a cleaner body through a hose or an extension pipe. Due to this structure, the canister-type vacuum cleaner provides an unrestricted freedom of manipulating the suction inlet body compared to the upright-type vacuum cleaner. Accordingly, the canister-type vacuum cleaner can easily clean hard-to-clean areas such as floors, stairs, and narrow areas that the upright-type vacuum cleaner cannot easily reach.

U.S. Pat. No. 4,377,882 and EP1464257 disclose an upright vacuum cleaner that comprises a hose and an extension pipe in a cleaner body and employs a suction path switching structure to guide dust and air drawn in from a cleaning surface to a dust-collecting unit through the extension pipe in canister cleaning mode, thereby acting as both an upright-type vacuum cleaner and a canister-type vacuum cleaner.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides an upright vacuum cleaner that switches between suction paths by movement of an operating duct disposed above the suction paths.

The above aspects and/or other features of the present disclosure can substantially be achieved by providing an upright vacuum cleaner comprising a cleaner body which comprises a suction motor, a dust collecting unit, and a body frame in which the suction motor and the dust-collecting unit are disposed; a suction inlet body which is hinged to a lower end of the body frame; a hose whereof a first side is in fluid communication with the body frame and a second side is in fluid communication with an extension pipe through a manipulation handle; and a suction path switching unit which is disposed on the back of the body frame and has an operating duct elastically arranged on a suction path to be able to slide up and down. As the extension pipe is inserted into or withdrawn from a socket disposed longitudinally on the back of the body frame, the operating duct may selectively divert the suction path to a first suction path flowing from the suction inlet body to the dust collecting unit or a second suction path flowing from the extension pipe to the dust collecting unit.

The suction path switching unit may comprise a first suction duct, a first side of which fluidly communicates with the suction inlet body, a second suction duct, a first side of which fluidly communicates with the hose; and a guide duct which fluidly communicates with the dust collecting unit. A first side of the operating duct may be in fluid communication with the guide duct and a second side may selectively fluidly communicate with second sides of the first suction duct and the second suction duct.

The first side of the operating duct may be slidably inserted into the guide duct, and the second sides of the first suction duct and the second suction duct may be arranged such that the operating duct moves up and down to fluidly communicate with the first suction duct or the second suction duct.

The operating duct may be formed integrally with a push projection pressed or released by the extension pipe, which is slidably inserted into the socket on an upper outer circumference of the operating duct to be inserted into or withdrawn from the socket.

As the push projection is released by the extension pipe and upwardly and elastically supported by a return spring, the operating duct may fluidly communicate with the second suction duct.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF EXEMPLARY EMBODIMENTS

Hereinafter, an upright vacuum cleaner employing a suction path switching structure according to an exemplary embodiment of the present disclosure will now be described in detail with reference to the accompanying drawings.

Figure 1:
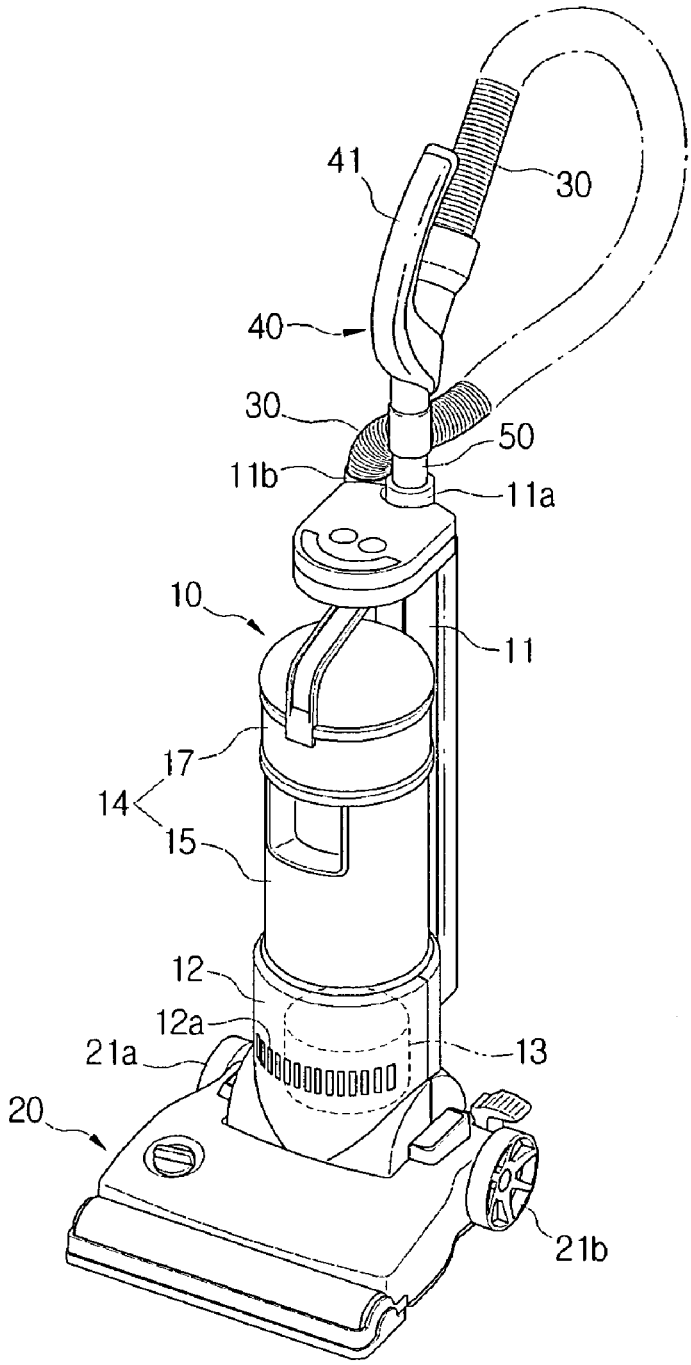
FIG. 1 is a perspective view illustrating an upright vacuum cleaner according to an exemplary embodiment of the present disclosure.
Figure 2:
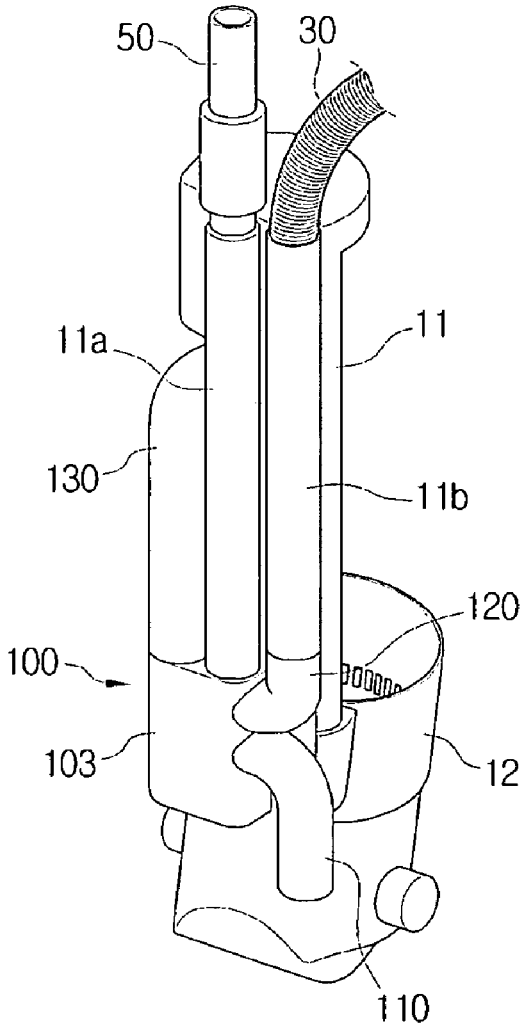
FIG. 2 is a perspective view schematically illustrating a suction path switching unit mounted on the back of a body frame of the upright vacuum cleaner of FIG. 1.

Referring to FIGS. 1 and 2, an upright vacuum cleaner according to an exemplary embodiment of the present disclosure includes a main body 10, a suction inlet body 20, a hose 30, a manipulation handle 40, an extension pipe 50, and a suction path switching unit 100.

The main body 10 includes a body frame 11, a suction motor 13, a dust receptacle 15 and a dust separator 17. The suction inlet body 20 is hingedly connected to a lower side of the body frame 11, and the suction motor 13 is mounted in a motor casing 12. A dust collecting unit 14, which includes the dust receptacle 15 and the dust separator 17, is mounted above the suction motor 13. The body frame 11 has a socket 11*a* longitudinally disposed on the back thereof, and the extension pipe 50 is inserted into the socket 11*a*. The hose 30 fluidly communicates with one side of the socket 11*a*, and a suction passage 11*b* is formed in parallel with the socket 11*a*.

The suction motor 13 is disposed inside the motor casing 12, which is disposed under the body frame 11. The suction motor 13 fluidly communicates with the dust separator 17 such that air from which dust is separated by the dust separator 17 is discharged to the outside through an air discharge hole 12*a* of the motor casing 12.

The dust separator 17 separates dust from air drawn in using a suction force exerted from the suction motor 13, and the separated dust is then collected in the dust receptacle 15 disposed under the dust separator 17. The dust separator 17 may desirably adopt a cyclone structure that separates dust from air using the centrifugal force. However, this should not be considered as limiting and a dust-bag (not shown) may be employed to collect dust instead of the cyclone structure.

The suction inlet body 20 includes a suction inlet (not shown) disposed on a bottom surface thereof to draw in dust and air from a surface to be cleaned through a first suction duct 110 (referring to FIG. 2), and includes a pair of traveling wheels 21*a* and 21*b* disposed at opposite rear sides of the suction inlet body 20 to easily travel over the surface to be cleaned. Here, the pair of traveling wheels 21*a* and 21*b* are rotatably connected to the suction inlet body 20.

The hose 30 is flexible in its length, and one side thereof fluidly communicates with one side of the manipulation handle 40 and the opposite side thereof fluidly communicates with the suction passage 11*b*. The manipulation handle 40 includes a grip unit 41 through which a user may grip the handle. The grip unit 41 to be held by a user is disposed between the hose 30 and the extension pipe 50 to allow fluid communication therebetween.

The extension pipe 50 has a predetermined length, and is withdrawn from the socket 11*a* in order to be used, and an extra accessory nozzle (not shown) is attached to a free end 51 (referring to FIG. 4) of the extension pipe 50 so that the vacuum cleaner can act as a canister vacuum cleaner using the extension pipe 50. When not in use, the extension pipe 50 is inserted into the socket 11*a* and fixed to the body frame 11, and the suction path is changed, so that the vacuum cleaner can act as an upright vacuum cleaner drawing in dust and air through the suction inlet body 20. That is, a push projection 141 is pressed or released as the extension pipe 50 is inserted into or withdrawn from the socket 11*a*, and according to the operation of the push projection 141, the suction path for dust and air may be switched to a first suction path P1 (FIG. 3) or a second suction path P2 (FIG. 4).

The extension pipe 50 may have a telescopic structure so that the length thereof can be adjusted when the vacuum cleaner acts as a canister vacuum cleaner. Additionally, the extension pipe 50 may be designed to be higher than the body frame 11 so that a user can easily push and pull the suction inlet body 20 in an upright cleaning mode.

Figure 3:
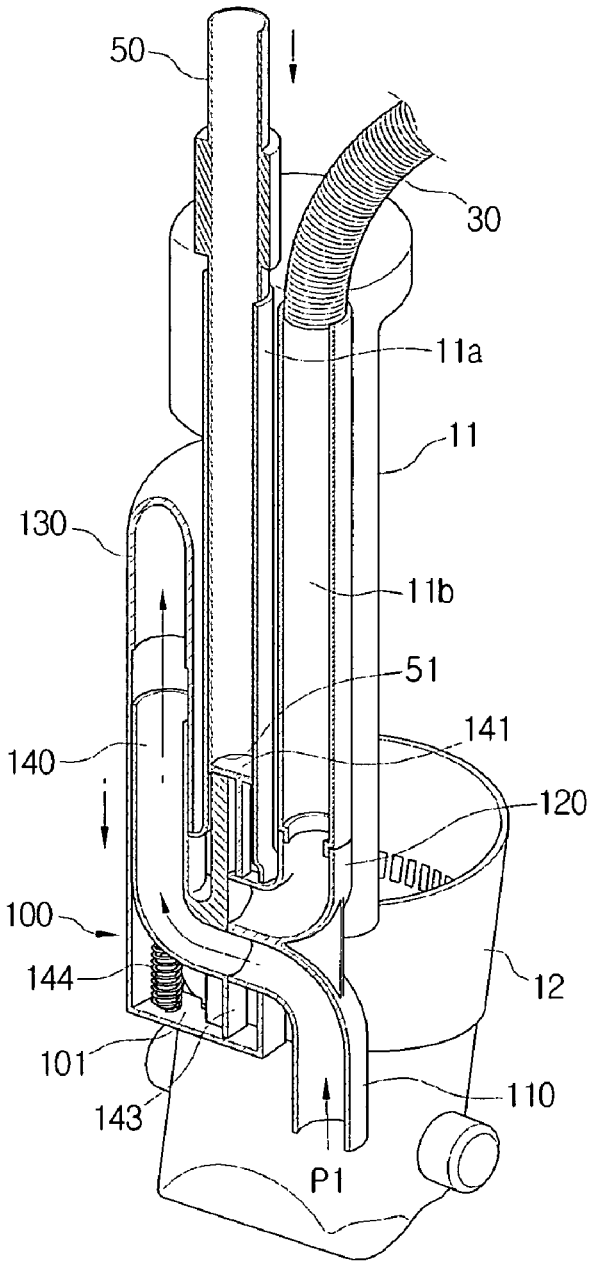
FIGS. 3 and 4 are schematic cross-section views illustrating operational states of the suction path switching unit of FIG. 2.
Figure 4:
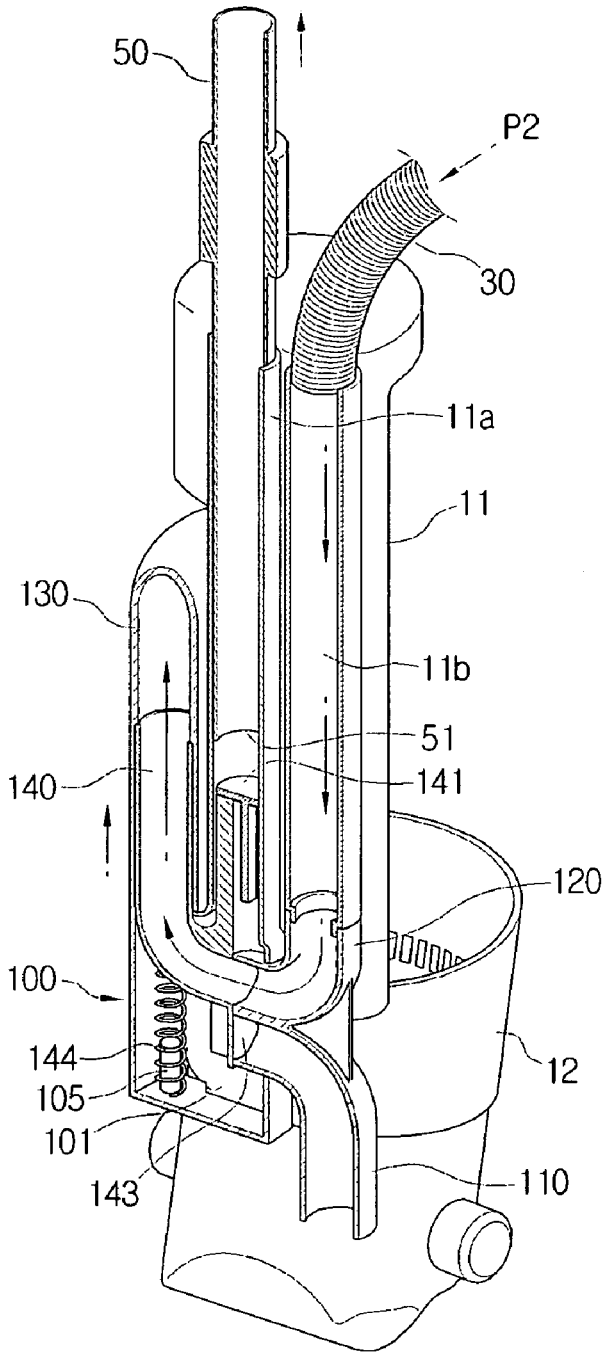

Referring to FIGS. 2 to 4, the suction path switching unit 100 according to the exemplary embodiment of the present disclosure will now be described. The suction path switching unit 100 includes a first suction duct 110, a second suction duct 120, a guide duct 130, and an operating duct 140.

One side of the first suction duct 110 is in fluid communication with the suction inlet body 20, and an opposite side is bent so as to be inserted into a path switching chamber 101. One side of the second suction duct 120 is in fluid communication with the suction passage 11*b*, and an opposite side is bent so as to be inserted into the path switching chamber 101. In this situation, each of the opposite sides of the first suction duct 110 and second suction duct 120 is vertically parallel to one another. In this manner, as the operating duct 140 moves up as shown in FIG. 4, the operating duct 140 fluidly communicates with the second suction duct 120 to define the second suction path P2. In contrast, as the operating duct 140 moves down as shown in FIG. 3, the operating duct 140 fluidly communicates with the first suction duct 110 to define the first suction path P1. Accordingly, ends of the opposite sides of the first and second suction ducts 110, 120 may be disposed on the same perpendicular line. Here, the path switching chamber 101 may be protected from any external shock by a cover 103.

One end of the guide duct 130 is in fluid communication with the dust separator 17, and is disposed vertically in parallel with one side of the socket 11*a*. Additionally, the guide duct 130 guides dust and air drawn in from the operating duct 140 to the dust separator 17.

One side of the operating duct 140 is slidably inserted into the guide duct 130, and an opposite side is bent and extends a distance sufficient to be selectively in contact with the opposite side of the first suction duct 110 or with the opposite side of the second suction duct 120. The push projection 141 inserted into the socket 11*a* is integrally formed on an outer circumference of the operating duct 140, and a return spring 144 mounted in the path switching chamber 101 is disposed below the operating duct 140 to elastically and upwardly support an opposite side of the operating duct 140. A lower end of the return spring 144 is fixed by a fixing projection 105 disposed inside the path switching chamber 101, and an upper end is fixed in a predetermined position on the lower outer circumference of the operating duct 140.

In this situation, when the extension pipe 50 is inserted into the socket 11*a* as shown in FIG. 3, the operating duct 140 is in fluid communication with the first suction duct 110 while sliding down along the guide duct 130 as the push projection 141 is pressed by the extension pipe 50. Alternatively, when the extension pipe 50 is withdrawn from the socket 11*a* as shown in FIG. 4, the operating duct 140 is in fluid communication with the second suction duct 120 while the push projection 141 that has been pressed by the extension pipe 50 is made to slide upwards by the return spring 144.

A partition 143 extends from a lower end of the operating duct 140. As shown in FIG. 4, when the operating duct 140 is in fluid communication with the second suction duct 120, the partition 143 blocks the first suction duct 110 so that it is possible to prevent dust from flowing into the path switching chamber 101 through the first suction duct 110 in advance.

Hereinafter, a process of switching between the first suction path P1 and the second suction path P2 of the upright vacuum cleaner according to the exemplary embodiment of the present disclosure will now be described with reference to FIGS. 3 and 4.

As shown in FIG. 3, in order to draw in dust and air from a cleaning surface through the suction inlet body 20, the extension pipe 50 is inserted into the socket 11*a*. In this case, as the push projection 141 is pressed down by the free end 51 of the extension pipe 50, the operating duct 140 integrally formed with the push projection 141 moves down to compress the return spring 144, so that the operating duct 140 may be in fluid communication with the first suction duct 110 and the first suction path P1 may be ensured.

If the suction motor 13 is driven in this state, dust and air are drawn into the suction inlet body 20 through a suction inlet (not shown) of the suction inlet body 20 in contact with the surface to be cleaned, and then flow into the operating duct 140 through the first suction duct 110. The dust and air passing through the operating duct 140 then flow into the dust separator 17 along the guide duct 130, and the dust is then separated from the air by the centrifugal force and collected in the dust receptacle 15 due to its own weight. The air separated from the dust is discharged to the outside through a discharge outlet (not shown) of the dust separator 17 in fluid communication with the suction motor 13 and then through the suction motor 13.

On the other hand, in order to perform a canister cleaning operation using the extension pipe 50, the extension pipe 50 is withdrawn from the socket 11*a* as shown in FIG. 4. Accordingly, the push projection 141 that has been pressed by the extension pipe 50 is released by the extension pipe 50, and the operating duct 140 thus moves upwards due to the elastic force of the return spring 144.

In this situation, the operating duct 140 fluidly communicates with the second suction duct 120 instead of the first suction duct 110 so that the suction path may be switched from the first suction path P1 to the second suction path P2 and the partition 143 blocks the first suction duct 110.

In this state, if an appropriate accessory nozzle (not shown) is mounted on the free end 51 of the extension pipe 50 withdrawn from the socket 11*a* and the suction motor 13 is driven, dust and air flow into the suction passage 11*b* after passing in sequence through the accessory nozzle, the extension pipe 50, the manipulation handle 40, and the hose 30.

The dust and air drawn into the suction passage 11*b* flows into the operating duct 140 through the second suction duct 120, and then into the dust separator 17 through the guide duct 130. The dust drawn into the dust separator 17 is separated from the air by the centrifugal force in the dust separator 17 and collected in the dust receptacle 15 due to its own weight, and the air from which the dust is separated is discharged to the outside through the discharge outlet (not shown) of the dust separator 17 fluidly communicating with the suction motor 13 and then through the suction motor 13.

As described above, according to the exemplary embodiment of the present disclosure, the suction path can be switched using the guide duct 130 and the operating duct 140, which is capable of selectively fluidly communicating with the first suction duct 110 or the second suction duct 120, rather than by closing and opening an extra space. Therefore, unnecessary pressure loss on the suction path can be prevented when the suction path is switched.

According to the exemplary embodiments of the present disclosure, the suction path can be diverted simply by inserting the extension pipe into and withdrawing the extension pipe from the socket of the body frame. Additionally, the operating duct connected to the guide duct can be moved directly to fluidly communicate with the first suction duct or the second suction duct so it is possible to reduce unnecessary pressure loss resulting from switching the suction path.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. An upright vacuum cleaner, comprising:

a cleaner body which comprises a suction motor, a dust collecting unit, and a body frame in which the suction motor and the dust-collecting unit are disposed;

a suction inlet body that is hinged to a lower end of the body frame;

a hose having a first side in fluid communication with the body frame and a second side in fluid communication with an extension pipe through a manipulation handle; and a suction path switching unit that is disposed on the back of the body frame and has an operating duct elastically arranged on a suction path to be able to slide up and down, wherein, as the extension pipe is inserted into or withdrawn from a socket disposed longitudinally on the back of the body frame, the operating duct selectively diverts the suction path to a first suction path flowing from the suction inlet body to the dust collecting unit or a second suction path flowing from the extension pipe to the dust collecting unit.

2. The upright vacuum cleaner as claimed in claim 1, wherein the suction path switching unit comprises:

a first suction duct, a first side of which fluidly communicates with the suction inlet body;

a second suction duct, a first side of which fluidly communicates with the hose; and a guide duct which fluidly communicates with the dust collecting unit, wherein a first side of the operating duct is in fluid communication with the guide duct and a second side selectively fluidly communicates with second sides of the first suction duct and the second suction duct.

3. The upright vacuum cleaner as claimed in claim 2, wherein the first side of the operating duct is slidably inserted into the guide duct, and the second sides of the first suction duct and the second suction duct are arranged such that the operating duct moves up and down to fluidly communicate with the first suction duct or the second suction duct.

4. The upright vacuum cleaner as claimed in claim 2, wherein the operating duct is formed integrally with a push projection pressed or released by the extension pipe, which is slidably inserted into the socket on an upper outer circumference of the operating duct to be inserted into or withdrawn from the socket.

5. The upright vacuum cleaner as claimed in claim 4, wherein, as the push projection is released by the extension pipe and upwardly and elastically supported by a return spring, the operating duct fluidly communicates with the second suction duct.

6. An upright vacuum cleaner, comprising:

a cleaner body having a body frame;

a suction inlet body hinged to the body frame;

a manipulation handle having an extension pipe and a hose;

an operating duct in the cleaner body for sliding movement between a first position and a second position, the operating duct being elastically biased to the second position by an elastic member, the operating duct having an operating duct open end;

a guide duct placing the cleaner body and the operating duct in fluid communication with one another in both the first and second positions of the operating duct;

a first suction duct having an end in fluid communication with the suction inlet body and a first suction duct open end;

a second suction duct having an end in fluid communication with the hose and a second suction duct open end, the first and second suction duct open ends being disposed on a common perpendicular line with the operating duct open end so that when the operating duct is in the first position the operating duct open end is in fluid communication with the first suction duct open end and when the operating duct is in the second position the operating duct open end is in fluid communication with the second suction duct open end; and a socket defined on the body frame, the extension pipe sliding the operating duct along the common perpendicular line to the first position when the extension pipe is received in the socket and the elastic member sliding the operating duct along the common perpendicular line to the second position when the extension pipe is not received in the socket.

7. The upright vacuum cleaner as claimed in claim 6, wherein the operating duct further comprises a partition extending therefrom, the operating duct being disposed on the common perpendicular line so that when the operating duct is in the second position the partition blocks the first suction duct open end.

8. The upright vacuum cleaner as claimed in claim 7, wherein the operating duct further comprises a push projection extending into the socket so that a free end of the extension pipe acts on the push projection when the extension pipe is received in the socket to move the operating duct to the second position.

* * * * *